US010274237B2

(12) United States Patent
Junge et al.

(10) Patent No.: US 10,274,237 B2
(45) Date of Patent: Apr. 30, 2019

(54) ICE MAKER FOR AN APPLIANCE

(71) Applicant: Haier US Appliance Solutions, Inc., Wilmington, DE (US)

(72) Inventors: Brent Alden Junge, Evansville, IN (US); Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 123 days.

(21) Appl. No.: 15/420,664

(22) Filed: Jan. 31, 2017

(65) Prior Publication Data

US 2018/0216862 A1 Aug. 2, 2018

(51) Int. Cl.

| | |
|---|---|
| ***F25C 1/04*** | (2018.01) |
| ***F25C 1/18*** | (2006.01) |
| ***F25C 1/25*** | (2018.01) |
| ***F25C 5/20*** | (2018.01) |

(52) U.S. Cl.

CPC ..... *F25C 1/18* (2013.01); *F25C 1/04* (2013.01); *F25C 1/25* (2018.01); *F25C 5/22* (2018.01); *F25C 2600/04* (2013.01)

(58) Field of Classification Search

CPC ..... F25C 1/08; F25C 5/22; F25C 1/04; F25C 1/25; F25C 1/24

See application file for complete search history.

(56) References Cited

U.S. PATENT DOCUMENTS

| | | | |
|---|---|---|---|
| 3,995,636 | A | 12/1976 | Murray et al. |
| 4,497,707 | A | 2/1985 | Anderson |
| 4,521,309 | A | 6/1985 | Pall |
| 4,619,677 | A | 10/1986 | Matheson et al. |
| 4,855,077 | A | 8/1989 | Shikinami et al. |
| 4,912,942 | A | 4/1990 | Katterhenry et al. |
| 5,089,144 | A | 2/1992 | Ozkahyaoglu et al. |
| 5,135,645 | A | 8/1992 | Sklenak et al. |
| 5,171,430 | A | 12/1992 | Beach et al. |
| 5,190,666 | A | 3/1993 | Bisconte |
| 5,192,424 | A | 3/1993 | Beyne et al. |
| 5,328,597 | A | 7/1994 | Boldt, Jr. et al. |

(Continued)

FOREIGN PATENT DOCUMENTS

| | | | |
|---|---|---|---|
| CN | 2514297 | Y | 10/2002 |
| EP | 1936305 | A2 | 6/2008 |

(Continued)

OTHER PUBLICATIONS

PCT Search Report and Written Opinion PCT/US2014/056282, dated Nov. 27, 2014. (11 pages).

(Continued)

*Primary Examiner* — Elizabeth J Martin

(74) *Attorney, Agent, or Firm* — Dority & Manning, P.A.

(57) ABSTRACT

An ice maker includes a plurality of fingers extending into a tub. A manifold has a plurality of outlets. The plurality of outlets is positioned below the plurality of fingers within the tub. A multi-speed pump is operable to flow liquid water from a reservoir to the manifold such that the liquid water exits the manifold at each outlet of the plurality of outlets and flows upwardly towards the plurality of fingers. A controller is configured for changing a speed of the multi-speed pump during an ice making cycle of the ice maker.

18 Claims, 6 Drawing Sheets

(56) References Cited

U.S. PATENT DOCUMENTS

| | | | |
|---|---|---|---|
| 5,536,264 | A | 7/1996 | Hsueh et al. |
| 5,907,958 | A | 6/1999 | Coates et al. |
| 6,009,404 | A | 12/1999 | Eimer |
| 6,051,144 | A | 4/2000 | Clack et al. |
| 6,139,738 | A | 10/2000 | Maxwell |
| 6,153,105 | A | 11/2000 | Tadlock et al. |
| 6,205,807 | B1 | 3/2001 | Broadbent |
| 6,303,031 | B1 | 10/2001 | Senner |
| 6,355,177 | B2 | 3/2002 | Senner et al. |
| 6,533,926 | B2 | 3/2003 | Hawkins et al. |
| 6,537,444 | B2 | 3/2003 | Wilberscheid et al. |
| 6,551,503 | B2 | 4/2003 | Niers et al. |
| 6,708,518 | B1 | 3/2004 | Jones et al. |
| 6,753,783 | B2 | 6/2004 | Friedman et al. |
| 6,865,941 | B2 | 3/2005 | Gibbs |
| 6,950,032 | B1 | 9/2005 | Hewitt et al. |
| 7,062,936 | B2 | 6/2006 | Rand et al. |
| 7,067,054 | B2 | 6/2006 | Fritze |
| RE39,361 | E | 10/2006 | Den Dekker |
| 7,481,917 | B2 | 1/2009 | Ikeyama et al. |
| 7,638,042 | B2 | 12/2009 | Astle et al. |
| 7,736,495 | B2 | 6/2010 | Ikeyama et al. |
| 7,836,708 | B2 | 11/2010 | Krause et al. |
| 7,874,457 | B2 | 1/2011 | Sowers et al. |
| 8,025,186 | B2 | 9/2011 | Lee et al. |
| 8,057,669 | B2 | 11/2011 | Beard et al. |
| 8,118,997 | B2 | 2/2012 | Ebrom et al. |
| 8,196,809 | B2 | 6/2012 | Thorstensson |
| 8,216,463 | B1 | 7/2012 | Baird |
| 8,240,159 | B2 | 8/2012 | Prabhakar et al. |
| 8,242,893 | B1 | 8/2012 | Lin |
| 8,282,820 | B2 | 10/2012 | Cur et al. |
| 8,289,173 | B2 | 10/2012 | Ben-Mansour et al. |
| 8,459,047 | B2 | 6/2013 | Hall et al. |
| 8,544,291 | B2 | 10/2013 | Kim et al. |
| 8,695,371 | B2 | 4/2014 | Boarman et al. |
| 8,746,003 | B2 | 6/2014 | Yoon |
| 8,844,314 | B2 | 9/2014 | Bortoletto et al. |
| 8,950,197 | B2 | 2/2015 | Bortoletto et al. |
| 9,046,299 | B2 | 6/2015 | An et al. |
| 9,074,802 | B2 | 7/2015 | Culley et al. |
| 9,074,803 | B2 | 7/2015 | Culley |
| 9,080,800 | B2 | 7/2015 | Culley |
| 9,151,527 | B2 | 10/2015 | Boarman et al. |
| 9,273,890 | B2 | 3/2016 | Bortoletto et al. |
| 9,303,903 | B2 | 4/2016 | Boarman et al. |
| 9,506,682 | B2 | 11/2016 | Yun et al. |
| 10,072,888 | B2 | 9/2018 | Jeong et al. |
| 2002/0189983 | A1 | 12/2002 | Guess et al. |
| 2004/0001991 | A1 | 1/2004 | Kinkelaar et al. |
| 2004/0007516 | A1 | 1/2004 | Fritze et al. |
| 2004/0025527 | A1* | 2/2004 | Takahashi ..... F25C 1/18 62/340 |
| 2004/0251210 | A1 | 12/2004 | Fritze et al. |
| 2005/0092070 | A1 | 5/2005 | Bhatti |
| 2005/0167352 | A1 | 8/2005 | Burrows et al. |
| 2005/0194317 | A1 | 9/2005 | Ikeyama et al. |
| 2006/0011523 | A1 | 1/2006 | Schrott et al. |
| 2006/0060512 | A1 | 3/2006 | Astle et al. |
| 2006/0186031 | A1 | 8/2006 | Fick et al. |
| 2008/0034761 | A1 | 2/2008 | Hartley |
| 2008/0055112 | A1 | 3/2008 | McGinty et al. |
| 2009/0046715 | A1 | 2/2009 | McCoy |
| 2009/0134074 | A1 | 5/2009 | Doran |
| 2009/0293508 | A1 | 12/2009 | Rafalovich et al. |
| 2010/0100026 | A1 | 4/2010 | Morris |
| 2010/0218540 | A1 | 9/2010 | McCollough et al. |
| 2010/0275633 | A1 | 11/2010 | An et al. |
| 2011/0036109 | A1 | 2/2011 | Krause et al. |
| 2011/0036782 | A1 | 2/2011 | DiLeo |
| 2011/0062060 | A1 | 3/2011 | Royal et al. |
| 2011/0126576 | A1 | 6/2011 | Jeong |
| 2012/0118001 | A1 | 5/2012 | Mitchell et al. |
| 2012/0130330 | A1 | 5/2012 | Wilson et al. |
| 2012/0297817 | A1 | 11/2012 | Krause et al. |
| 2012/0324914 | A1* | 12/2012 | Bortoletto ..... F25C 1/08 62/66 |
| 2013/0008838 | A1 | 1/2013 | Burke et al. |
| 2013/0068673 | A1 | 3/2013 | Maggiore et al. |
| 2013/0240431 | A1 | 9/2013 | Foix et al. |
| 2014/0018727 | A1 | 1/2014 | Burbank et al. |
| 2014/0110331 | A1 | 4/2014 | Baird |
| 2014/0158638 | A1 | 6/2014 | Caulkins et al. |
| 2014/0200538 | A1 | 7/2014 | Euliano et al. |
| 2014/0305930 | A1 | 10/2014 | Heizer et al. |
| 2014/0353235 | A1 | 12/2014 | Sherman et al. |
| 2015/0101669 | A1 | 4/2015 | Kraus et al. |
| 2015/0102931 | A1 | 4/2015 | Chernov et al. |
| 2015/0135758 | A1 | 5/2015 | Miller |
| 2015/0192338 | A1* | 7/2015 | Knatt ..... F25C 1/00 62/66 |
| 2015/0290567 | A1 | 10/2015 | Chernov et al. |
| 2015/0290568 | A1 | 10/2015 | Chernov et al. |
| 2015/0290569 | A1 | 10/2015 | Chernov et al. |
| 2016/0025406 | A1 | 1/2016 | An |

FOREIGN PATENT DOCUMENTS

| | | | |
|---|---|---|---|
| JP | 2001016025 | A | 1/2001 |
| JP | 2003192096 | A | 7/2003 |
| JP | 3665260 | B2 | 6/2005 |
| JP | 2006258684 | A | 9/2006 |
| JP | 2007147356 | A | 6/2007 |
| JP | 2007163255 | A | 6/2007 |
| KR | 20120120844 | A | 11/2012 |
| WO | WO 83/02523 | A1 | 7/1983 |
| WO | WO 97/38272 | A1 | 10/1997 |
| WO | WO 03/011426 | A1 | 2/2003 |
| WO | WO 03/084875 | A1 | 10/2003 |
| WO | WO 2004/037383 | A1 | 5/2004 |
| WO | WO 2007068506 | A1 | 6/2007 |
| WO | WO 2008061179 | A2 | 5/2008 |
| WO | WO 2008/125530 | A1 | 10/2008 |

OTHER PUBLICATIONS

PCT Search Report and Written Opinion PCT/US2014/060223, dated Jan. 23, 2015. (9 pages).

* cited by examiner

ICE MAKER FOR AN APPLIANCE

FIELD OF THE INVENTION

The present subject matter relates generally to ice makers for appliances, such as refrigerator appliances or freestanding ice maker appliances.

BACKGROUND OF THE INVENTION

Certain appliances include an icemaker. To produce ice, liquid water is directed to the ice maker and frozen. A variety of ice types can be produced depending upon the particular ice maker used. For example, certain ice makers include a mold body for receiving liquid water. Within the mold body, liquid water is stationary and freezes to form ice cubes. Such ice makers can also include a heater and/or an auger for harvesting ice cubes from the mold body.

Freezing stationary water within a mold body to form ice cubes has certain drawbacks. For example, ice cubes produced in such a manner can be cloudy or opaque, and certain consumers prefer clear ice cubes. Ice formation within the mold body can also be relatively slow such that maintaining a sufficient supply of ice cubes during periods of high demand is difficult. Further, icemakers with such mold bodies can occupy large volumes of valuable space within refrigerator appliances. In addition, forming spherical ice within a mold body can be difficult.

Accordingly, an ice maker for an appliance with features for generating clear ice, i.e., ice without significant air bubbles, gas, particulates and/or chlorine, would be useful. In addition, an ice maker for an appliance with features for generating clear ice quickly and/or efficiently would be useful. Also, an ice maker for an appliance that generates spherical clear ice would be useful.

BRIEF DESCRIPTION OF THE INVENTION

The present subject matter provides an ice maker for an appliance. The ice maker includes a plurality of fingers extending into a tub. A manifold has a plurality of outlets. The plurality of outlets is positioned below the plurality of fingers within the tub. A multi-speed pump is operable to flow water from a reservoir to the manifold such that the water exits the manifold at each outlet of the plurality of outlets and flows upwardly towards the plurality of fingers. A controller is configured for changing a speed of the multi-speed pump during an ice making cycle of the ice maker. Additional aspects and advantages of the invention will be set forth in part in the following description, or may be apparent from the description, or may be learned through practice of the invention.

In a first exemplary embodiment, an appliance is provided. The appliance includes a cabinet. An ice maker is disposed within the cabinet. The ice maker includes a tub. A plurality of fingers extends into the tub. A manifold has a plurality of outlets. The plurality of outlets is positioned below the plurality of fingers within the tub. The ice maker also includes a reservoir. A multi-speed pump is operable to flow liquid water from the reservoir to the manifold such that the liquid water exits the manifold at each outlet of the plurality of outlets and flows upwardly towards the the plurality of fingers. A controller is in operative communication with the multi-speed pump. The controller is configured for changing a speed of the multi-speed pump during an ice making cycle of the ice maker. A height of liquid water within the tub varies as a function of the speed of the multi-speed pump during the ice making cycle of the ice maker.

In a second exemplary embodiment, an appliance is provided. The appliance includes a cabinet. A sealed system is positioned within the cabinet. The sealed system is charged within refrigerant and includes a compressor, a condenser, a throttling device and an evaporator connected in series. An ice maker is disposed within the cabinet. The ice maker includes a tub. A plurality of fingers extends into the tub. The evaporator is coupled to or formed within the plurality of fingers such that the plurality of fingers is chilled during operation of the sealed system. A manifold has a plurality of outlets. Each outlet of the plurality of outlets is positioned below a respective one of the plurality of fingers within the tub. The ice maker also includes a reservoir. A supply line extends between the reservoir and the manifold. A return line extends between the tub and the reservoir. A multi-speed pump is operable to flow liquid water from the reservoir to the manifold via the supply line such that the liquid water exits the manifold at each outlet of the plurality of outlets and flows upwardly towards the respective one of the plurality of fingers. A controller is in operative communication with the multi-speed pump. The controller is configured for operating the compressor and for changing a speed of the multi-speed pump during an ice making cycle of the ice maker. A height of liquid water within the tub varies as a function of the speed of the multi-speed pump during the ice making cycle of the ice maker.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
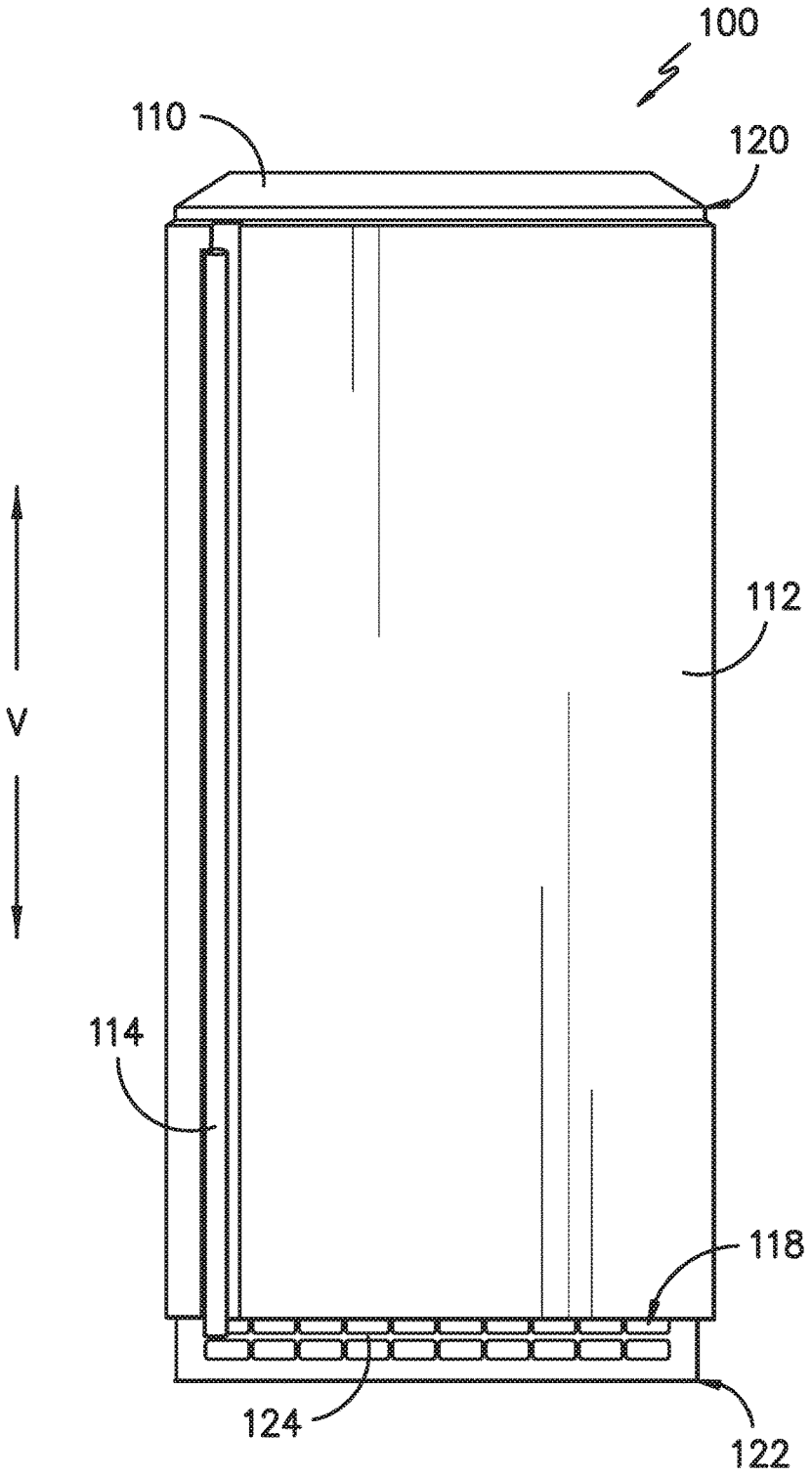
FIG. 1 provides a perspective view of an ice making appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
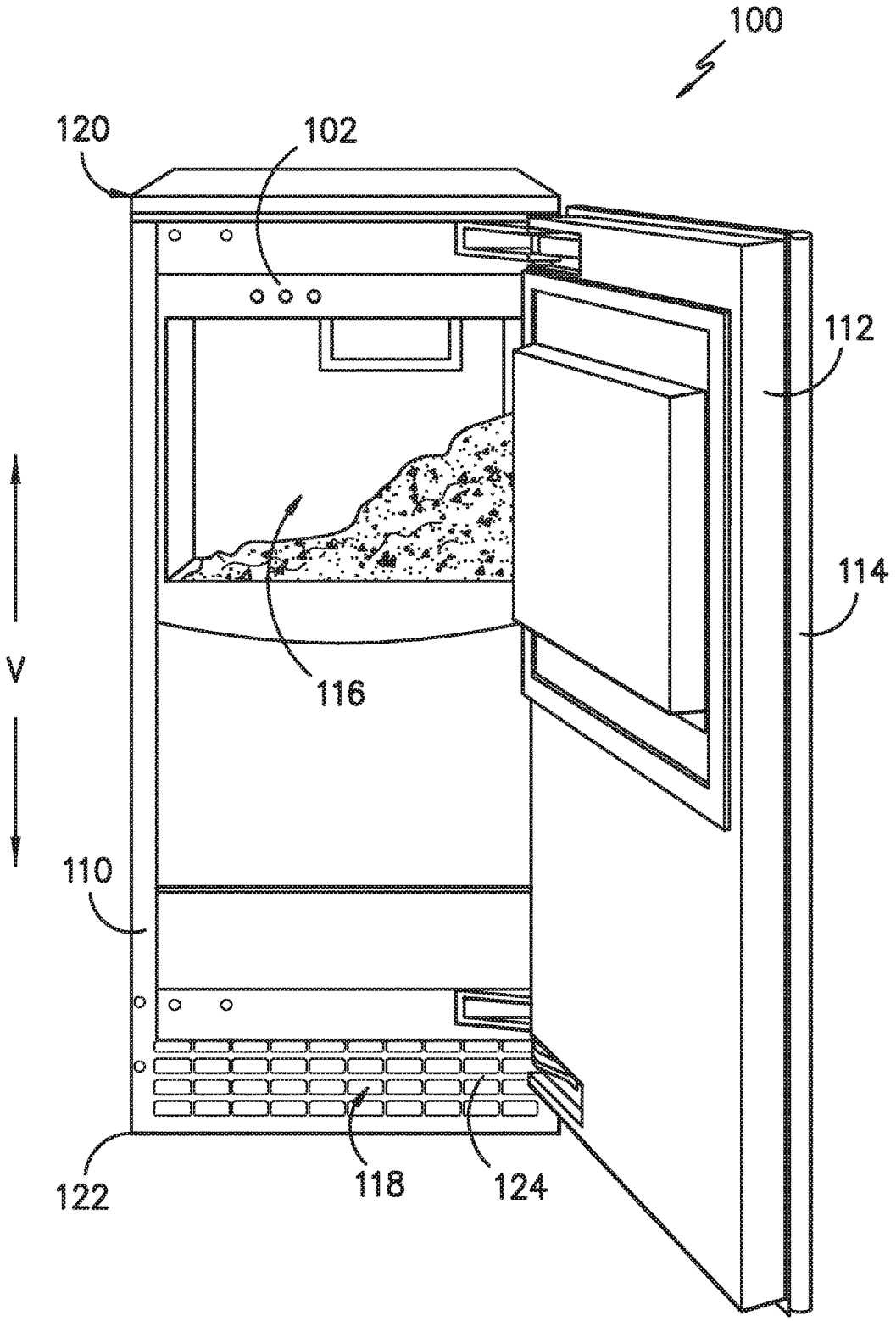
FIG. 2 provides a perspective view of the exemplary ice making appliance of FIG. 1 with a door of the exemplary ice making appliance shown in an open position.

FIGS. 1 and 2 provide perspective views of an ice making appliance 100 according to an exemplary embodiment of the present subject matter. As shown in FIGS. 1 and 2, ice making appliance 100 includes a cabinet 110 and a door 112. In FIG. 1, a door 112 of ice making appliance 100 shown in a closed position. Door 112 of ice making appliance 100 is shown in an open position in FIG. 2. Door 112 may be rotatably hinged to cabinet 110 such that a user may pull on a handle 114 of door 112 (or directly on door 112) to adjust door 112 between the open and closed positions. In the closed position, door 112 blocks access to and assists with sealing an ice storage chamber 116 within cabinet 110. The user may rotate door 112 to the open position to access ice storage chamber 116 and ice stored therein.

Cabinet 110 extends between a top portion 120 and a bottom portion 122, e.g., along a vertical direction V. Ice storage chamber 116 may be positioned at or proximate top portion 120 of cabinet 110. A machinery compartment 118 may be positioned within cabinet 110, e.g., at or adjacent bottom portion 122 of cabinet 110. Cabinet 110 may include insulation (not shown) between ice storage chamber 116 and machinery compartment 118 in order to limit heat transfer between ice storage chamber 116 and machinery compartment 118 through cabinet 110. A grill 124 at bottom portion 122 of cabinet 110 allows air flow between machinery compartment 118 and ambient air about cabinet 110.

While described in greater detail below in the context of ice making appliance 100, it will be understood that the present subject matter may be used in or within any suitable appliance in alternative exemplary embodiments. For example, the present subject matter may be used in or with ice making appliances having other arrangements or components than that shown in FIGS. 1 and 2. As another example, the present subject matter may be used in or with refrigerator appliances or freezer appliances in alternative exemplary embodiments. Thus, it will be understood that the present subject matter is not limited to use in freestanding ice making appliances.

Figure 3:
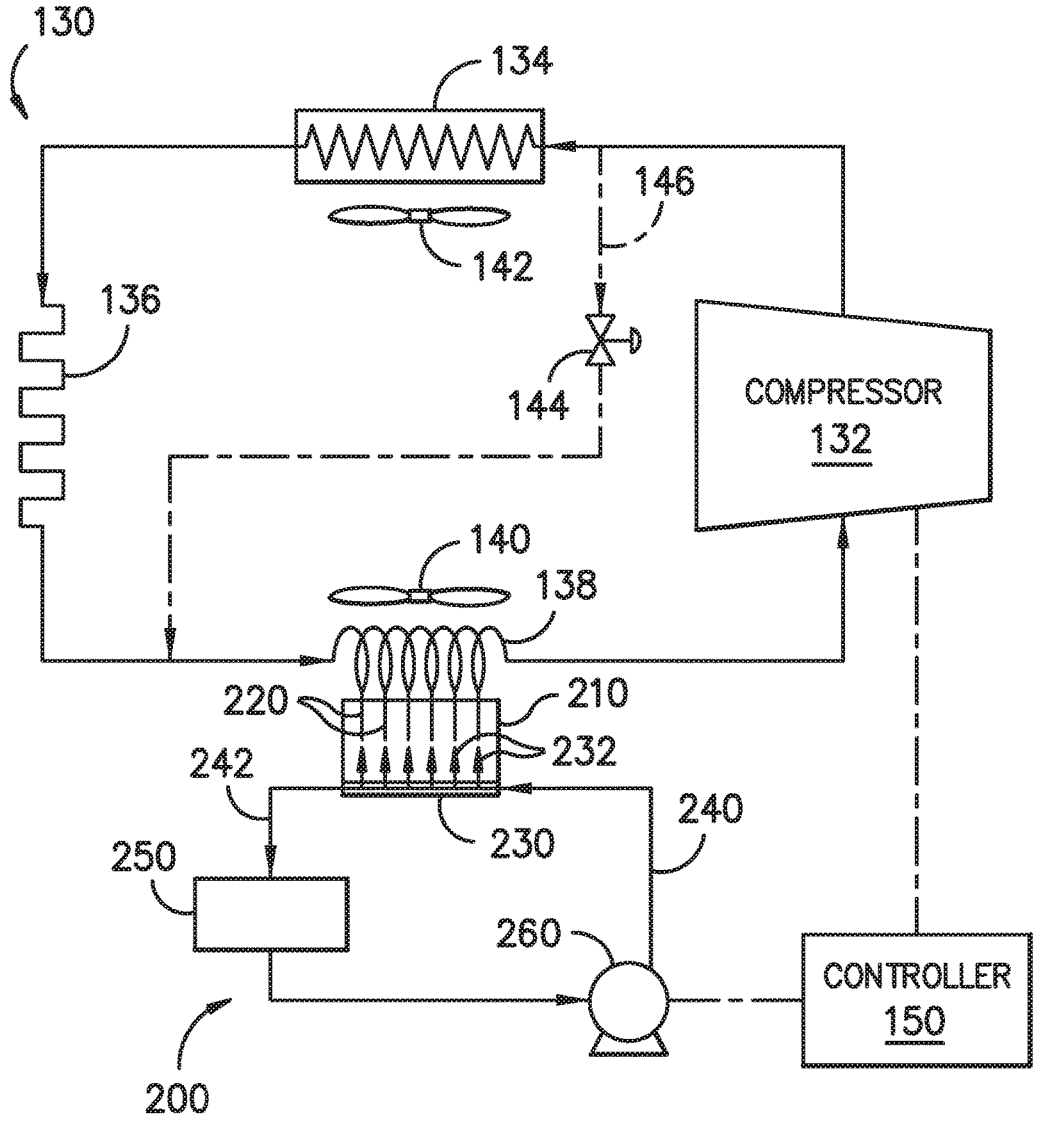
FIG. 3 provides a schematic view of certain components of the exemplary ice making appliance of FIG. 1.

FIG. 3 provides a schematic view of certain components of ice making appliance 100, including a sealed refrigeration system 130 that executes a known vapor compression cycle and an ice maker 200. Machinery compartment 118 contains certain components of sealed refrigeration system 130, and ice maker 200 may be positioned at or adjacent ice storage chamber 116. Sealed refrigeration system 130 includes a compressor 132, a condenser 134, a throttling or expansion device 136, and an evaporator 138 connected in series and charged with a refrigerant. Compressor 132, condenser 134 and/or expansion device 136 may be positioned at or within machinery compartment 118 while evaporator 138 may be positioned at or adjacent ice storage chamber 116.

Within refrigeration system 130, refrigerant flows into compressor 132, which operates to increase the pressure of the refrigerant. This compression of the refrigerant raises its temperature, which is lowered by passing the refrigerant through condenser 134. Within condenser 134, heat exchange with ambient air takes place so as to cool the refrigerant. A condenser fan 142 is used to pull air across condenser 134 so as to provide forced convection for a more rapid and efficient heat exchange between the refrigerant within condenser 134 and the ambient air. Thus, as will be understood by those skilled in the art, increasing air flow across condenser 134 can, e.g., increase the efficiency of condenser 134 by improving cooling of the refrigerant contained therein.

An expansion device (e.g., a valve, capillary tube, or other throttling device) 136 receives refrigerant from condenser 134. From expansion device 136, the refrigerant enters evaporator 138. Upon exiting expansion device 136 and entering evaporator 138, the refrigerant drops in pressure. Due to the pressure drop and/or phase change of the refrigerant, evaporator 138 is cool relative to liquid water within ice maker 200. As such, evaporator 138 directly or indirectly refrigerates ice maker 200 in order to freeze liquid water within ice maker 200 and form ice therein, as discussed in greater detail below. As an example, evaporator 138 may be a type of heat exchanger that is mounted to or formed within ice maker 200 to directly cool ice maker 200. As another example, evaporator 138 may be a type of heat exchanger which transfers heat from air passing over evaporator 138 to refrigerant flowing through evaporator 138 and the chilled air from evaporator 138 may be flowed to ice maker 200 in order to indirectly cool ice maker 200 with the chilled air from evaporator 138. An evaporator fan 140 may be used to pull air across evaporator 138 and circulate air across or to ice maker 200.

Collectively, the vapor compression cycle components in a refrigeration circuit, associated fans, and associated compartments are sometimes referred to as a sealed refrigeration system. The refrigeration system 130 depicted in FIG. 3 is provided by way of example only. Thus, it is within the scope of the present subject matter for other configurations of the refrigeration system to be used as well. It will be understood that refrigeration system 130 may include additional components, e.g., at least one additional evaporator, compressor, expansion device, and/or condenser. As an example, refrigeration system 130 may include two evaporators.

As shown in FIG. 3, ice maker 200 includes a tub 210 and a plurality of ice formation fingers 220. Tub 210 is configured for containing a volume of liquid water, and fingers 220 extend into tub 210. During operation of refrigeration system 130, liquid water within tub 210 freezes onto fingers 220 and forms ice. As an example, evaporator 138 may be formed within fingers 220 such that refrigerant flows through or adjacent fingers 220 in order to freeze liquid water within tub 210 onto fingers 220. Thus, evaporator 138 may be referred to as a "finger evaporator."

Ice maker 200 also includes a manifold 230, a supply line 240, a return line 242, a reservoir 250 and a multi-speed pump 260. Manifold 230 has a plurality of outlets 232 (e.g., jet outlets), and outlets 232 and positioned and oriented for directing liquid water from manifold 230 into tub 210. Reservoir 250 is configured for storing a volume of liquid water therein. For example, reservoir 250 may be sized for storing a larger volume of liquid water than tub 210. Multi-speed pump 260 is operable to flow liquid water from reservoir 250 to manifold 230. For example, supply line 240 extends between reservoir 250 and manifold 230 such that liquid water from reservoir 250 may flow through supply line 240 to manifold 230 during operation of multi-speed pump 260, and multi-speed pump 260 may be coupled to supply line 240. Return line 242 extends between tub 210 and reservoir 250 such that liquid water from tub 210 may flow through return line 242 to reservoir 250 during operation of multi-speed pump 260. Thus, manifold 230, supply line 240, return line 242, reservoir 250 may form a hydraulic circuit with multi-speed pump 260 urging the liquid water through the hydraulic circuit.

The position and/or orientation of outlets 232 in combination with the various water velocities provided by multi-speed pump 260 may facilitate formation of clear ice on fingers 220. In particular, ice formed on fingers 220 may be clear and also have a desirable shape due to the position and/or orientation of outlets 232 in combination with the various water velocities provided by multi-speed pump 260. As may be seen in FIG. 3, outlets 232 are positioned below fingers 220 at or within tub 210. For example, each outlet of outlets 232 may be positioned below a respective one of fingers 220 at or within tub 210. In particular, each outlet of outlets 232 may be positioned directly below the respective one of fingers 220 at or within tub 210 along the vertical direction V, as shown in FIG. 3. As another example, each outlet of outlets 232 may be positioned below and angled towards the respective one(s) of fingers 220 at or within tub 210.

In certain exemplary embodiments, manifold 230 may be plumbed (e.g., with micro-channels) such that outlets 232 are in parallel with one another, e.g., in order to provide uniform water flow to each outlet of outlets 232. In addition, outlets 232 may have different sizes and/or shapes such that water flows from outlets 232 in different patterns and/or speeds. Further, a slider may be provided at outlets 232, with the slider configured to adjust a size and/or shape of outlets 232. Similar valves may be provided within manifold 230 to adjust the flow of liquid water from outlets 232.

Multi-speed pump 260 is operable to flow liquid water from reservoir 250 to manifold 230, e.g., such that the liquid water exits manifold 230 at each outlet of outlets 232 and flows upwardly towards the respective one of fingers 220. By varying the velocity or speed of liquid water exiting manifold 230 at outlets 232, liquid water flowing upwardly from outlets 232 towards fingers 220 may freeze onto fingers 220 in a desirable shape and/or without significant impurities or bubbles that cause cloudiness or opaqueness within ice on fingers 220. Such features of ice maker 200 are discussed in greater detail below with reference to FIGS. 4 and 5.

Operation of ice maker 200 can be regulated by controller 150 that is operatively coupled to various components of ice making appliance 100, such as multi-speed pump 260, compressor 132, evaporator fan 140, a bypass valve 144, a motor 270, etc. Controller 150 may include a, e.g., non-transitory, memory and one or more microprocessors, CPUs or the like, such as general or special purpose microprocessors operable to execute programming instructions or micro-control code associated with operation of ice maker 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may be positioned in a variety of locations throughout ice making appliance 100. In the illustrated embodiment, controller 150 is located within a control panel 102 at top portion 120 of cabinet 110 (FIG. 2). In other embodiments, the controller 150 may be positioned at any suitable location within ice making appliance 100. Input/output ("I/O") signals may be routed between controller 150 and various operational components of ice making appliance 100. For example, control panel 102 and user inputs, such as buttons, dials, etc. on control panel 102, may be in communication with controller 150 via one or more signal lines or shared communication busses.

As discussed above, ice forms on fingers 220 of ice maker 200 during operation of refrigeration system 130, e.g., when controller 150 operates compressor 132. As shown in FIG. 3 and as discussed above, refrigeration system 130 includes compressor 132, condenser 134, expansion device 136 and evaporator 138 that are connected to each other in a loop in order to execute a known vapor compression. Refrigeration system 130 also includes a bypass valve 144 and a bypass conduit 146 that interrupt the normal refrigerant operating loop of refrigeration system 130 during a harvest operation of refrigeration system 130.

Bypass valve 144 is disposed downstream of compressor 132, e.g., and upstream of condenser 134 and/or expansion device 136. Thus, refrigerant from compressor 132 flows to bypass valve 144 within refrigeration system 130 during operation of compressor 132. As an example, bypass valve 144 may be a two-way valve, such as a two-way solenoid valve. As another example, bypass valve 144 may be a three-way valve, such as a three-way solenoid valve. Bypass conduit 146 fluidly couples bypass valve 144 and evaporator 138 such that refrigerant at bypass valve 144 may flow through bypass conduit 146 to evaporator 138, e.g., around condenser 134 and/or expansion device 136. As an example, bypass conduit 146 may be (e.g., aluminum or copper) tubing or piping that extends from bypass valve 144 to an inlet of evaporator 138. Thus, bypass valve 144 and evaporator 138 may be in direct fluid communication with each other via bypass conduit 146.

Bypass valve 144 is selectively adjustable, e.g., by controller 150, between a normal operating configuration and a harvest or bypass operating configuration. In the normal operating configuration, bypass valve 144 may be closed such that refrigerant from compressor 132 flows through condenser 134 to expansion device 136 and evaporator 138 during operation of compressor 132. Thus, refrigerant flows through refrigeration system 130 in the manner described above with reference to FIG. 3 when bypass valve 144 is in the normal operating configuration such that refrigeration system 130 operates to cool ice maker 200 with evaporator 138. Conversely, refrigerant from compressor 132 flows through bypass valve 144 to evaporator 138 during operation of compressor 132 in the bypass operating configuration. Thus, refrigerant from compressor 132 bypasses condenser 134 and/or expansion device 136 in the bypass operating configuration such that refrigeration system 130 does not operate to cool ice maker 200. By actuating from the normal operating configuration to the bypass operating configuration, bypass valve 144 may assist with implementing a harvest cycle of refrigeration system 130.

Refrigerant at an inlet of evaporator 138 is hotter when bypass valve 144 is in the bypass operating configuration compared to when bypass valve 144 is in the normal operating configuration. Thus, refrigerant delivered to evaporator 138 via bypass conduit 146 may flow into evaporator 138 and heat evaporator 138 after shifting bypass valve 144 from normal operating configuration to the bypass operating configuration. By heating evaporator 138, the refrigerant within evaporator 138 melts ice on fingers 220 and thereby harvests the ice. Thus, bypass valve 144 and bypass conduit 146 may assist with harvesting ice from fingers 220 by bypassing refrigerant flow around condenser 134 and/or expansion device 136 and delivering refrigerant that is hotter than the freezing temperature of water into evaporator 138. As an example, when bypass valve 144 is in the bypass operating configuration, refrigerant entering evaporator 138 from bypass conduit 146 may have a temperature no less than sixty degrees Celsius (60° C.).

As discussed above, controller 150 is in operative communication with multi-speed pump 260. Thus, controller 150 may selectively activate multi-speed pump 260 to flow liquid water from reservoir 250 to manifold 230 in order to form suitably shaped clear ice. In particular, controller 150 may change a speed of the multi-speed pump 260 during ice making operations of ice maker 200 in order to form suitably shaped ice on fingers 220. As discussed in greater detail below, a height H of liquid water W within tub 210 varies as a function of the speed of multi-speed pump 260 during ice making operations of ice maker 200. Thus, controller 150 may change the height H of liquid water W within tub 210 by changing the speed of multi-speed pump 260 in order to form suitably shaped ice on fingers 220.

Figure 4:
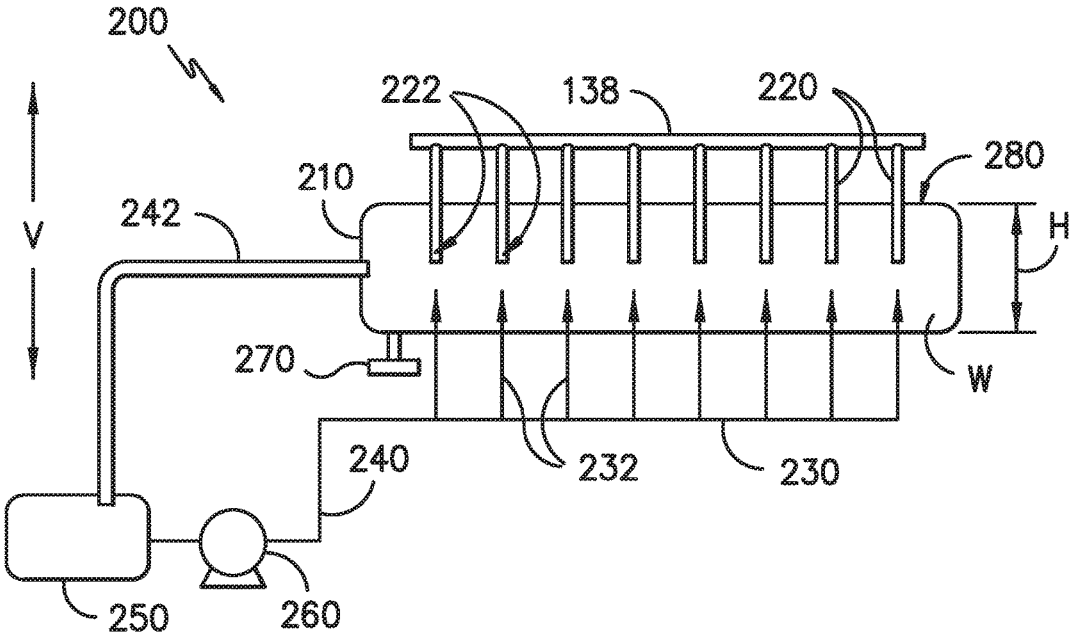
FIGS. 4 and 5 provide schematic views of an ice maker according to an exemplary embodiment of the present subject matter.
Figure 5:
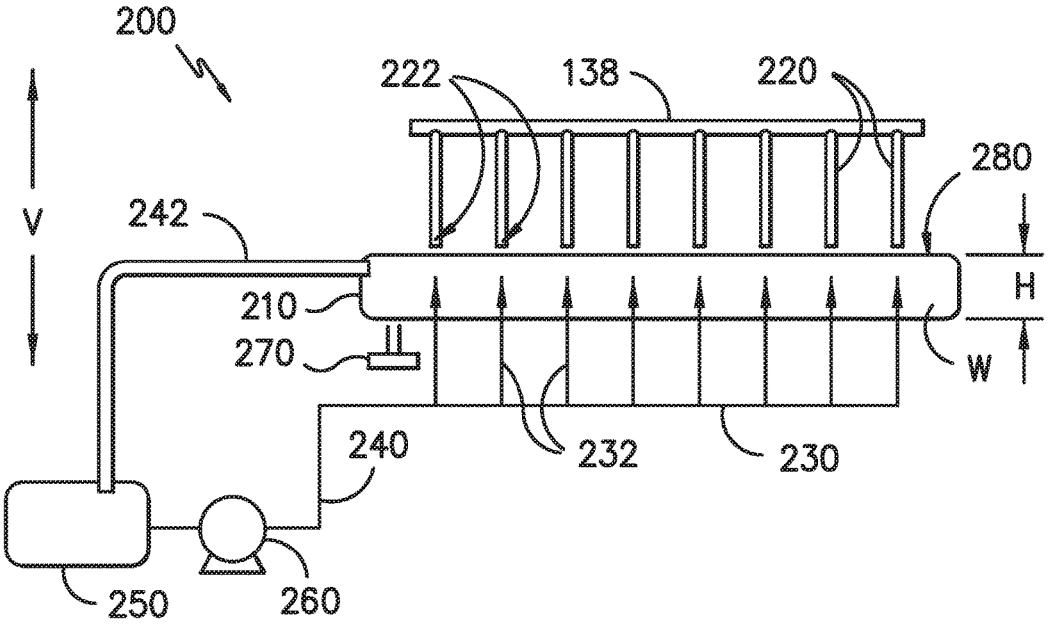

FIGS. 4 and 5 provide schematic views of ice maker 200. In FIG. 4, controller 150 operates multi-speed pump 260 at a first speed of multi-speed pump 260. In FIG. 5, controller 150 operates multi-speed pump 260 at a second speed of multi-speed pump 260. Multi-speed pump 260 is selectively operable at either of the first speed and the second speed. A position of a surface 280 of liquid water W (e.g., along the vertical direction V) within tub 210 changes between the first and second speeds of multi-speed pump 260. Thus, the surface of liquid water W may be moved by changing the speed of multi-speed pump 260 between the first and second speeds.

The first and second speeds are different. In particular, the first speed is greater than the second speed such that the height H of liquid water W within tub 210 at the first speed of multi-speed pump 260 is greater than the height H of liquid water W within tub 210 at the second speed of multi-speed pump 260. For example, as shown in FIG. 4, surface 280 of liquid water W within tub 210 touches (e.g., is level with or positioned at a common location along the vertical direction V) tips 222 of fingers 220 when multi-speed pump 260 operates at the first speed. Conversely, as shown in FIG. 5, tips 222 of fingers 220 are submerged by the liquid water W within tub 210 when multi-speed pump 260 operates at the second speed. Thus, controller 150 may selectively submerge ends or tips 222 of fingers 220 below surface 280 of liquid water W within tub 210 by switching multi-speed pump 260 between the first and second speeds.

During ice making operations of ice maker 200, refrigeration system 130 operates to chill fingers 220 to a temperature below the freezing point of water. Thus, liquid water W within tub 210 may freeze onto fingers 220 during ice making operations of ice maker 200. Flowing liquid water through tub 210 with multi-speed pump 260 may assist with forming ice on fingers 220 with a suitable shape and/or clarity during ice making operations of ice maker 200.

To facilitate operation of ice maker 200, return line 242 may be sized to match a capacity of multi-speed pump 260. Thus, return line 242 may be sized to avoid or limit overflow of tub 210 when multi-speed pump 260 operates at maximum speed, such as the second speed. In addition, an inlet of return line 242 at tub 210 may be positioned such that surface 280 of liquid water W within tub 210 touches tips 222 of fingers 220 when multi-speed pump 260 operates at the first speed.

Figure 6:
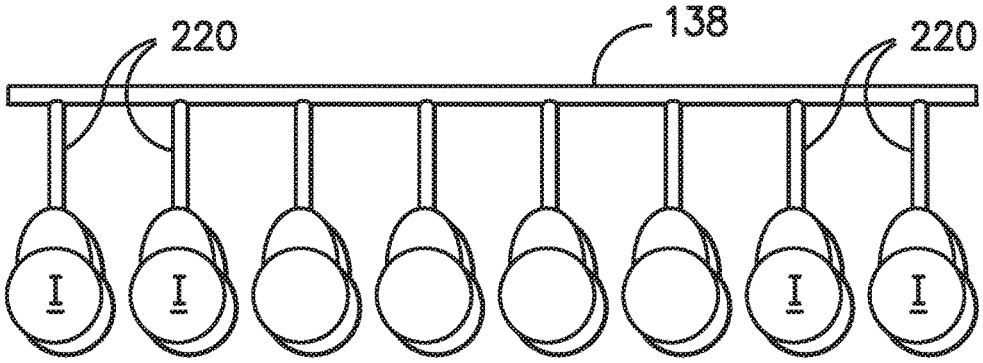
FIG. 6 provides a side, elevation view of ice formed with the exemplary ice maker of FIGS. 4 and 5.

Operation of ice maker 200 during ice making operations of ice maker 200 will now be discussed in greater detail below. During ice making operations, refrigeration system 130 operates to chill fingers 220 to a temperature below the freezing point of water such that ice forms on fingers 220. Thus, controller 150 may activate compressor 132 and close bypass valve 144 during ice making operations of ice maker 200. Controller 150 may also activate multi-speed pump 260 to flow liquid water from reservoir 250 to manifold 230 via supply line 240. In particular, controller 150 may repeatedly switch multi-speed pump 260 between the first and second speeds during ice making operations of ice maker 200 in order to change the height H of liquid water W within tub 210. As liquid water from reservoir 250 flows into tub 210 via outlets 232 of manifold 230, the liquid water may flow against fingers 220. For example, at the first speed of multi-speed pump 260, the flows of liquid water from outlets 232 of manifold 230 may flow against or to tips 222 of fingers 220, and liquid water from outlets 222 may freeze against or to tips 222 of fingers 220. At the second speed of multi-speed pump 260, the flows of liquid water from outlets 232 of manifold 230 may flow around or over tips 222 of fingers 220, and liquid water from outlets 222 may freeze over tips 222 of fingers 220. The changes in the flow of liquid water around fingers 220 caused by changing the speed of multi-speed pump 260 may facilitate formation of generally spherical or pear shape ice (labeled "I" in FIG. 6) on fingers 220, such as shown in FIG. 6, during ice making operations of ice maker 200. Flowing liquid water from outlets 232 of manifold 230 also assists with creating clear ice on fingers 220 because pure liquid water in tub 210 freezes more quickly on fingers 220 than liquid water in tub 210 that contains dissolved solids.

Controller 150 may switch multi-speed pump 260 between the first and second speeds in any suitable manner during ice making operations of ice maker 200. For example, controller 150 may operate multi-speed pump 260 such that multi-speed pump 260 changes in a continuous manner, e.g., linearly or sinusoidally, from the first speed to the second speed (or vice versa) during ice making operations of ice maker 200. As another example, controller 150 may operate multi-speed pump 260 such that multi-speed pump 260 changes in a discontinuous manner, e.g., stepwise, from the first speed to the second speed (or vice versa) during ice making operations of ice maker 200.

Operation of ice maker 200 during harvest operations of ice maker 200 will now be discussed in greater detail below. After ice making operations of ice maker 200, the ice on fingers 220 may be harvested or removed from fingers 220 for use during harvest operations of ice maker 200. Controller 150 may activate compressor 132 and open bypass valve 144 during harvest operations of ice maker 200. Controller 150 may also deactivate multi-speed pump 260 to terminate liquid water flow from reservoir 250 to manifold 230 via supply line 240. With bypass valve 144 open, refrigerant flows into evaporator 138 via bypass conduit 146 and heats evaporator 138 in the manner described above such that the ice on fingers 220 partially melts and slides from fingers 220.

During harvest operations of ice maker 200, a motor 270 coupled to one of tub 210 and fingers 220 moves the one of tub 210 and fingers 220 relative to the other of tub 210 and fingers 220 in order to remove fingers 220 from tub 210 and thereby avoid harvesting of the ice from fingers 220 into tub 210. The ice from fingers 220 may instead fall into ice storage chamber 116 of cabinet 110. Thus, ice maker 200 (e.g., fingers 220) may be positioned at or over ice storage chamber 116 of cabinet 110. Controller 150 may operate motor 270 to move the one of tub 210 and fingers 220 during harvest operations of ice maker 200.

Figure 7:
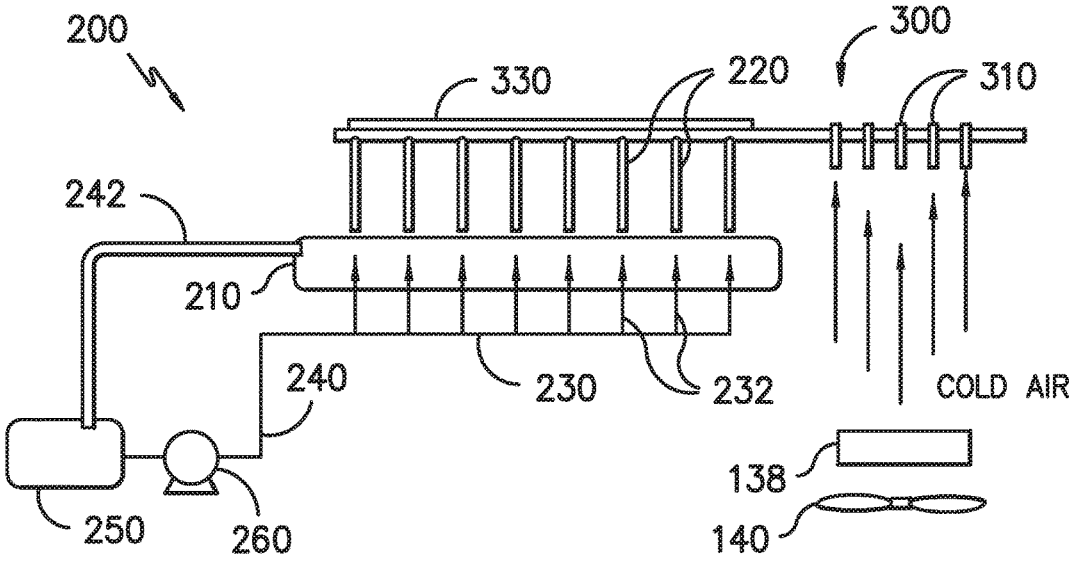
FIG. 7 provides a schematic view of an ice maker according to another exemplary embodiment of the present subject matter.
Figure 8:
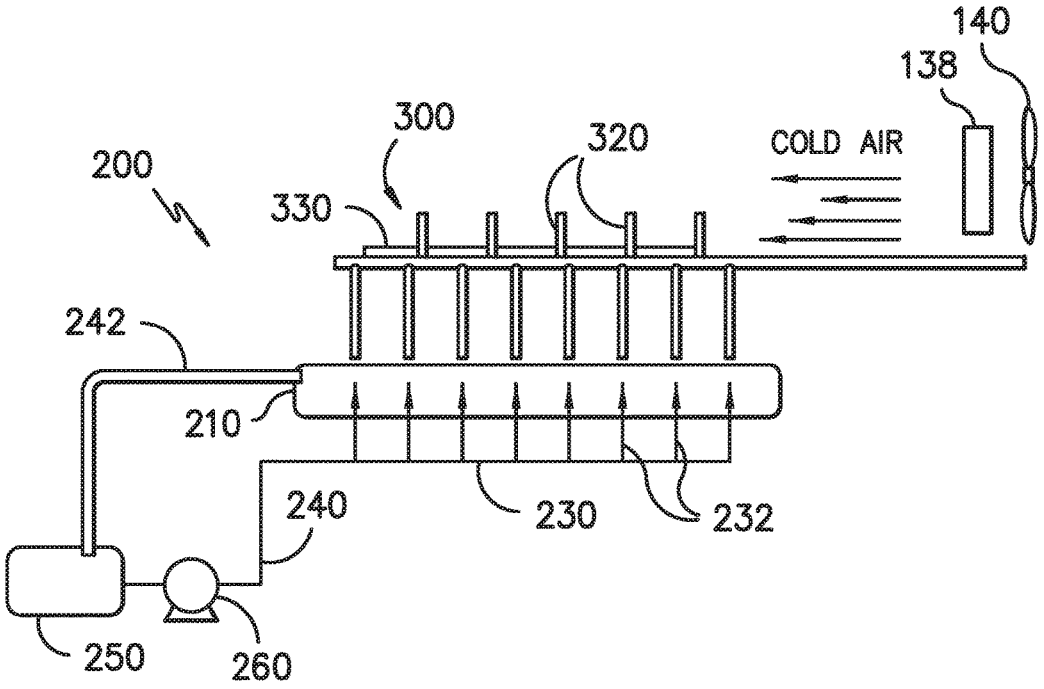
FIG. 8 provides a schematic view of an ice maker according to an additional exemplary embodiment of the present subject matter.

FIG. 7 provides a schematic view of ice maker 200 according to another exemplary embodiment of the present subject matter. FIG. 8 provides a schematic view of ice maker 200 according to an additional exemplary embodiment of the present subject matter. In FIGS. 7 and 8, ice maker 200 operates in a similar manner to that described above and includes similar components. However, in FIGS. 7 and 8, ice maker 200 is air cooled.

In FIGS. 7 and 8, ice maker 200 includes a heat exchanger 300 coupled to fingers 220. In particular, ice maker 200 includes a heat pipe heat exchanger 310 in FIG. 7 while ice maker 200 includes a heat sink heat exchanger 320 in FIG. 8. Heat exchanger 300 may be separate from and not in conductive thermal communication with evaporator 138. Thus, evaporator fan 140 may operate to blow chilled air from evaporator 138 to heat exchanger 300 in order to cool ice maker 200 via convective heat transfer between the heat exchanger 300 and blown chilled air from evaporator 138 during ice making operations of ice maker 200. In such a manner, as shown in FIGS. 7 and 8, refrigerant need not flow through fingers 220 during operation of ice maker 200 in certain exemplary embodiments. In FIGS. 7 and 8, ice maker 200 also include a resistance heating element 330 positioned on fingers 220 for heating fingers 220 during harvest operations of ice maker 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:
a cabinet;
an ice maker disposed within the cabinet, the ice maker comprising
a tub;
a plurality of fingers extending into the tub;
a manifold having a plurality of outlets, the plurality of outlets positioned below the plurality of fingers within the tub;
a reservoir;
a multi-speed pump operable to flow liquid water from the reservoir to the manifold such that the liquid water exits the manifold at each outlet of the plurality of outlets and flows upwardly towards the plurality of fingers; and
a controller in operative communication with the multi-speed pump, the controller configured for changing a speed of the multi-speed pump during an ice making cycle of the ice maker, a height of liquid water within the tub varying as a function of the speed of the multi-speed pump during the ice making cycle of the ice maker,
wherein the multi-speed pump is selectively operable at either of a first speed and a second speed, a surface of liquid water within the tub touching a tip of each finger of the plurality of finger when the multi-speed pump operates at the first speed, the tip of each finger of the plurality of fingers submerged by the liquid water within the tub when the multi-speed pump operates at the second speed.

2. The appliance of claim 1, further comprising a sealed system positioned within the cabinet, the sealed system charged with refrigerant and comprising a compressor, a condenser, a throttling device and an evaporator connected in series, the evaporator coupled to or formed within the plurality of fingers such that the plurality of fingers are chilled during operation of the sealed system.

3. The appliance of claim 2, further comprising a bypass conduit and a bypass valve, the bypass conduit extending around the condenser, the bypass valve coupled to the bypass conduit such that that the refrigerant bypasses the condenser through the bypass conduit during an ice harvesting cycle of the ice maker.

4. The appliance of claim 3, further comprising a motor coupled to one of the tub and the plurality of fingers in order to move the one of the tub and the plurality of fingers relative to the other of the tub and the plurality of fingers during the ice harvesting cycle of the ice maker, the fingers of the plurality of fingers removed from the tub during the ice harvesting cycle of the ice maker.

5. The appliance of claim 1, wherein the ice maker further comprises a supply line and a return line, the supply line extending between the reservoir and the manifold, the return line extending between the tub and the reservoir.

6. The appliance of claim 5, wherein the return line is sized to match a capacity of the multi-speed pump.

7. The appliance of claim 1, wherein the controller is configured for repeatedly switching the multi-speed pump between the first and second speeds during the ice making cycle of the ice maker.

8. The appliance of claim 7, wherein pear shaped ice forms on each finger of the plurality of fingers during the ice making cycle of the ice maker.

9. The appliance of claim 1, further comprising a fan and a sealed system positioned within the cabinet, the sealed system charged within refrigerant and comprising a compressor, a condenser, a throttling device and an evaporator connected in series, the fan operable to flow chilled air from the evaporator over a heat exchanger coupled to the plurality of fingers such that the plurality of fingers are chilled during operation of the sealed system and the fan.

10. The appliance of claim 9, further comprising a resistance heater coupled to the plurality of fingers, the resistance heater operable to heat the plurality of fingers during an ice harvesting cycle of the ice maker.

11. The appliance of claim 9, wherein the heat exchanger comprises a heat pipe.

12. The appliance of claim 9, wherein the heat exchanger comprises a heat sink.

13. An appliance, comprising:
a cabinet;
a sealed system positioned within the cabinet, the sealed system charged with refrigerant and comprising a compressor, a condenser, a throttling device and an evaporator connected in series;
an ice maker disposed within the cabinet, the ice maker comprising
a tub;

a plurality of fingers extending into the tub, the evaporator coupled to or formed within the plurality of fingers such that the plurality of fingers are chilled during operation of the sealed system;

a manifold having a plurality of outlets, each outlet of the plurality of outlets positioned below a respective one of the plurality of fingers within the tub;

a reservoir;

a supply line extending between the reservoir and the manifold;

a return line extending between the tub and the reservoir;

a multi-speed pump operable to flow liquid water from the reservoir to the manifold via the supply line such that the liquid water exits the manifold at each outlet of the plurality of outlets and flows upwardly towards the respective one of the plurality of fingers; and a controller in operative communication with the compressor and the multi-speed pump, the controller configured for operating the compressor and for changing a speed of the multi-speed pump during an ice making cycle of the ice maker, a height of liquid water within the tub varying as a function of the speed of the multi-speed pump during the ice making cycle of the ice maker, wherein the multi-speed pump is selectively operable at either of a first speed and a second speed, a surface of liquid water within the tub touching a tip of each finger of the plurality of fingers when the multi-speed pump operates at the first speed, the tip of each finger of the plurality of fingers submerged by the liquid water within the tub when the multi-speed pump operates at the second speed.

14. The appliance of claim 13, further comprising a bypass conduit and a bypass valve, the bypass conduit extending around the condenser, the bypass valve coupled to the bypass conduit such that that the refrigerant bypasses the condenser through the bypass conduit during an ice harvesting cycle of the ice maker.

15. The appliance of claim 14, further comprising a motor coupled to one of the tub and the plurality of fingers in order to move the one of the tub and the plurality of fingers relative to the other of the tub and the plurality of fingers during the ice harvesting cycle of the ice maker, the fingers of the plurality of fingers removed from the tub during the ice harvesting cycle of the ice maker.

16. The appliance of claim 13, wherein the return line is sized to match a capacity of the multi-speed pump.

17. The appliance of claim 13, wherein the controller is configured for repeatedly switching the multi-speed pump between the first and second speeds during the ice making cycle of the ice maker.

18. The appliance of claim 17, wherein pear shaped ice forms on each finger of the plurality of fingers during the ice making cycle of the ice maker.

* * * * *